United States Patent [19]

Fazio et al.

[11] Patent Number: 4,830,358

[45] Date of Patent: May 16, 1989

[54] RANDOM ACCESS SORTER

[75] Inventors: Dominick Fazio, Whippany, N.J.; Henry P. Braen, Wilton, Conn.

[73] Assignee: Gradco Acquisition Corporation, Danville, N.J.

[21] Appl. No.: 95,049

[22] Filed: Sep. 9, 1987

[51] Int. Cl.[4] ..... B65H 39/10

[52] U.S. Cl. ..... 271/296; 271/300; 271/302

[58] Field of Search ..... 271/296, 302, 300, 303, 271/288, 287, 297, 292, 176, 314, 220, 298, 81; 270/58; 414/51

[56] References Cited

U.S. PATENT DOCUMENTS

| | | | |
|---|---|---|---|
| 3,315,957 | 4/1967 | Mazzio et al. | 271/296 |
| 4,141,546 | 2/1979 | Queener | 271/288 |
| 4,265,445 | 5/1981 | Langner | 271/302 X |
| 4,288,070 | 9/1981 | Langner | 271/302 X |
| 4,317,203 | 2/1982 | Botte et al. | 270/58 X |

OTHER PUBLICATIONS

Haltiner, Jr., Karl J., "Sorter with a Moveable Transport", Xerox Disclosure Journal, vol. 9, No. 6, Nov./-Dec. 1984, pp. 369 and 370.

*Primary Examiner*—Joseph J. Rolla
*Assistant Examiner*—David H. Bollinger
*Attorney, Agent, or Firm*—Lerner, David, Littenberg, Krumholz & Mentlik

[57] ABSTRACT

A sorter in which the various paper trays of the sorter may be randomly accessed is disclosed. The sorter includes a plurality of paper-receiving trays which are stationarily arranged in vertically spaced-apart relationship to one another at the downstream end of the sorter, and an upstream paper transporting and guiding device for receiving paper sheets from an upstream machine and delivering the same to selected ones of the paper trays. The deflecting device is pivotable at its upstream end and has its downstream end arcuately movable between the various vertical positions of the paper trays. A suitable indexing mechanism is provided for indexing the paper transporting and guiding device to selected ones of the paper trays. In one embodiment the indexing mechanism comprises a DC motor geared to a sector gear carried by the paper transporting and paper guiding device, and in another embodiment the indexing mechanism comprises a Geneva Drive mechanism, including a pin wheel and a star gear wheel, coupled between the drive motor and the sector gear carried by the paper transporting and guiding device. Driven rollers positioned at the downstream end of the paper transporting and guiding device assist in transferring the paper sheets from the device to the paper receiving trays.

17 Claims, 11 Drawing Sheets

16
110
128
130
138
144
26, 64
140
142
129
278
276
274
273
172
132
173
134
136
280
282
46
36
38
48
50
26
28
34
35
30
32
22
40

RANDOM ACCESS SORTER

FIELD OF THE INVENTION

The present invention relates to sorters for laser printers, photocopiers and the like and, more particularly, to sorters in which the paper receiving rays are stationarily arranged and a pivotable deflector device is employed for directing the sheets of paper to selected ones of the trays.

BACKGROUND OF THE INVENTION

In early conventional sorters employed, for example, with laser printers and photocopiers, the sheets of paper representing the copies that are being delivered by the printing or copying machine are sorted in a sequential manner according to the arrangement of the paper-receiving trays. Conventionally the trays are moved sequentially past the exit plane of the machine and, after a sheet is deposited in each tray, the tray is moved to present the next tray in the sequence to the exit position of the machine.

More recently, sorters have been developed in which sorting occurs by employing stationarily mounted paper-receiving trays in conjunction with a deflectable upstream chute member which directs the successive sheets of paper sequentially from one tray to another. These sorters, referred to as "mailbox" sorters, an example of which is shown in U.S. Pat. No. 4,288,070 to Fred R. Langner, have employed paper chute mechanisms and indexing arrangements that heretofore have been inefficient and fragile, leading to operational failures of the sorter because of paper snags and the like.

The foregoing prior art forms of sorters are generally slow in operation, subject to frequent breakdown and have not lent themselves to random access sorting to facilitate the deposit of exiting sheets into the trays in other than a sequential manner.

It is, therefore, a primary object of the present invention to provide an improved sorter in which the various paper trays of the sorter may be randomly accessed.

Another object of the present invention is to provide an improved sorter in which the paper-receiving trays are stationarily arranged, and an improved pivotable deflector device is employed for directing the sheets of paper to a selected one of the trays.

A further object of the invention is to provide an improved sorter which is sturdy in construction and reliable in operation.

Additional objects and advantages of this invention will become apparent as the following description proceeds.

SUMMARY OF THE INVENTION

Briefly stated and in accordance with one embodiment of this invention, an improved sorter comprises a frame having a plurality of paper-receiving rays stationarily arranged at a downstream portion thereof, and a paper transporting and guiding device which is pivotally supported at its upstream end adjacent the input portion of the sorter and has its output end arcuately movable to positions adjacent the input ends of each of the trays. Suitable indexing means are provided to randomly index the downstream end of the paper transport and guiding device to selected ones of the paper trays, and drive means are provided for insuring that the paper is transferred from the transport and guide means to the selected paper trays.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

Referring to FIGS. 1–8B, a sorter in accordance with this invention has been illustrated generally at 10. The sorter 10 includes left and right side frame members 12 and 14, respectively, which are held in rigid spaced apart relationship by a plurality of cross members 16 (FIG. 1) and 18 and 20 (FIG. 8A). The frame members and cross members are preferably molded from a polycarbonate material having minor amounts of PTFE (e.g., 5%) and glass fibers (e.g., 10%).

Figure 1:
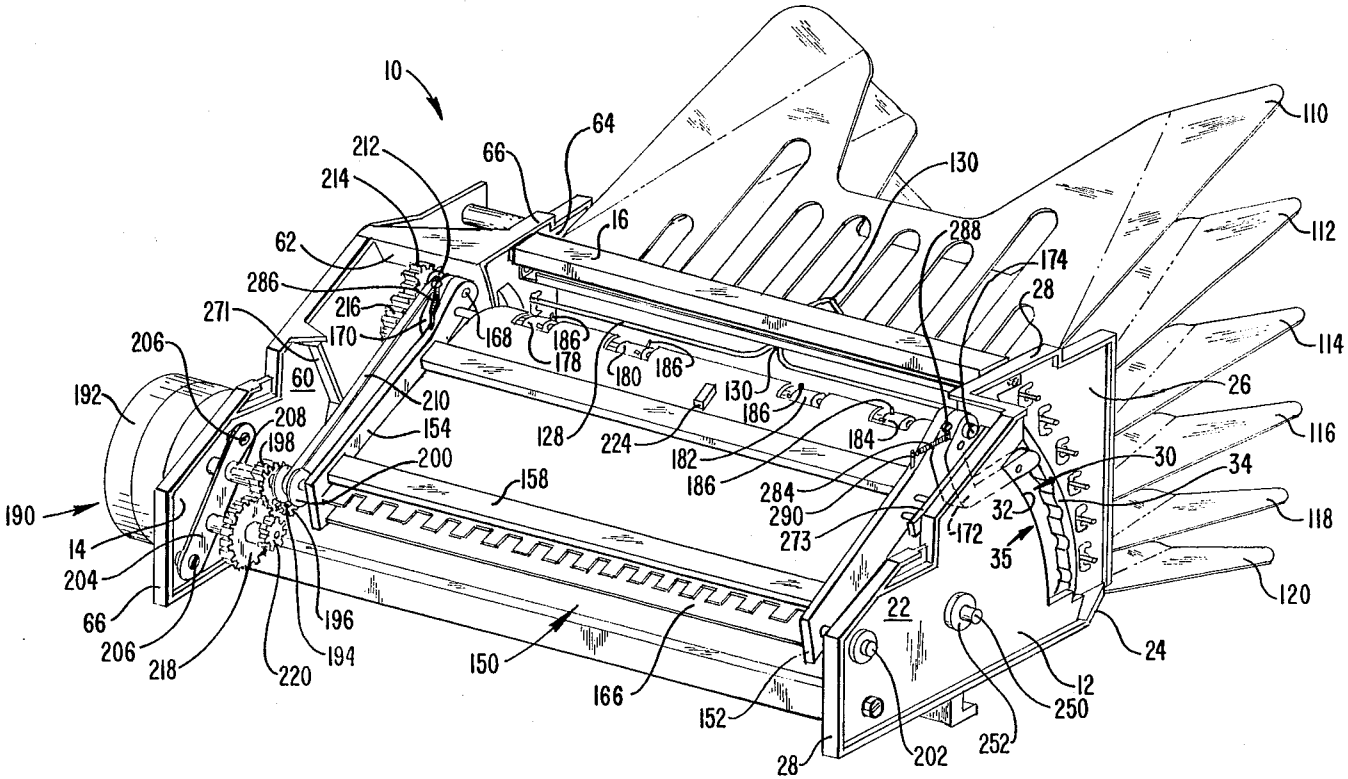
FIG. 1 is a perspective view of the sorter, with parts removed for clarity, as seen from a point to the left and in front of the sorter.
Figure 3:
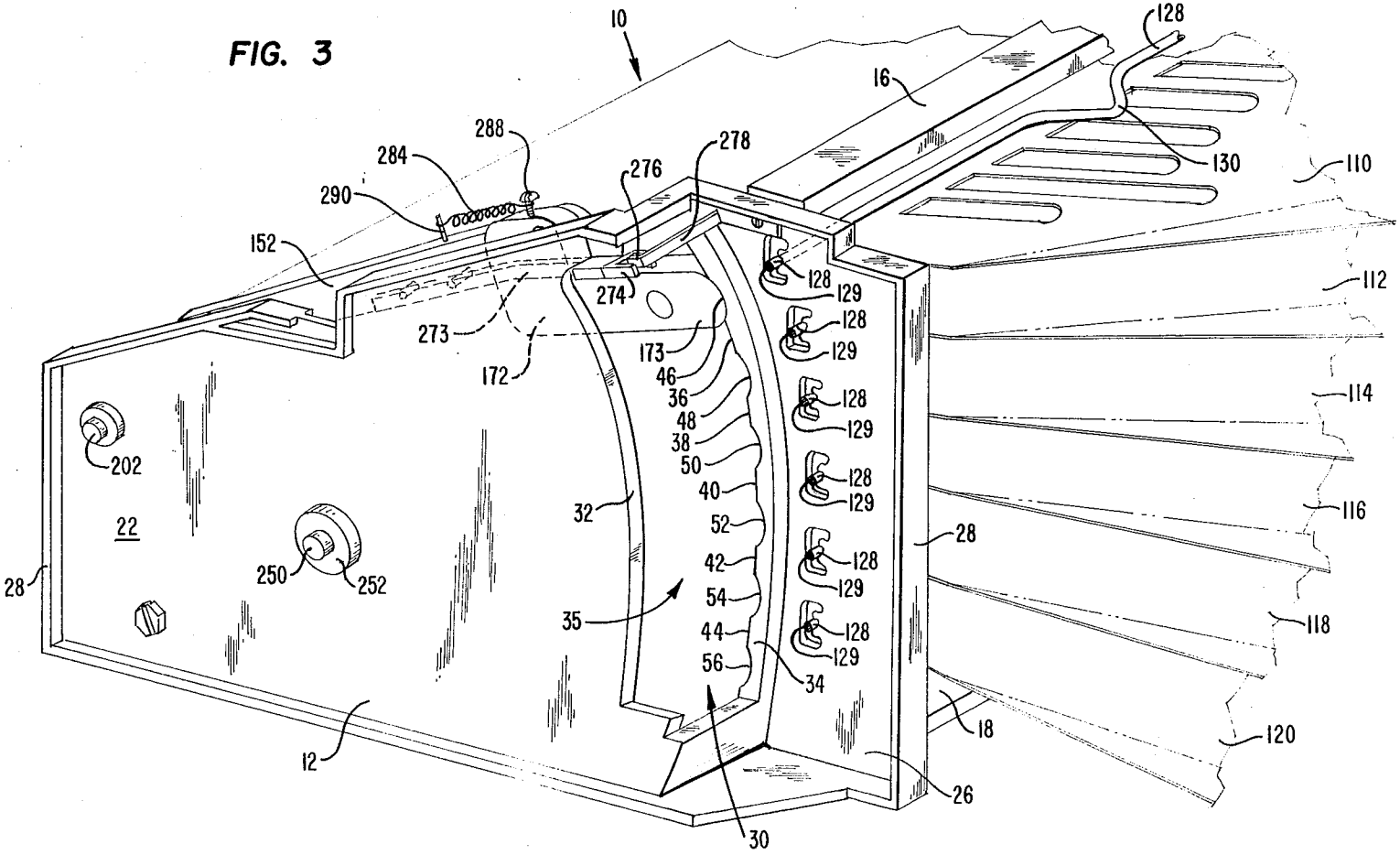
FIG. 3 is an enlarged partial perspective view of the sorter, with parts removed for clarity, as seen from a point to the rear and to the left thereof.
Figure 4:
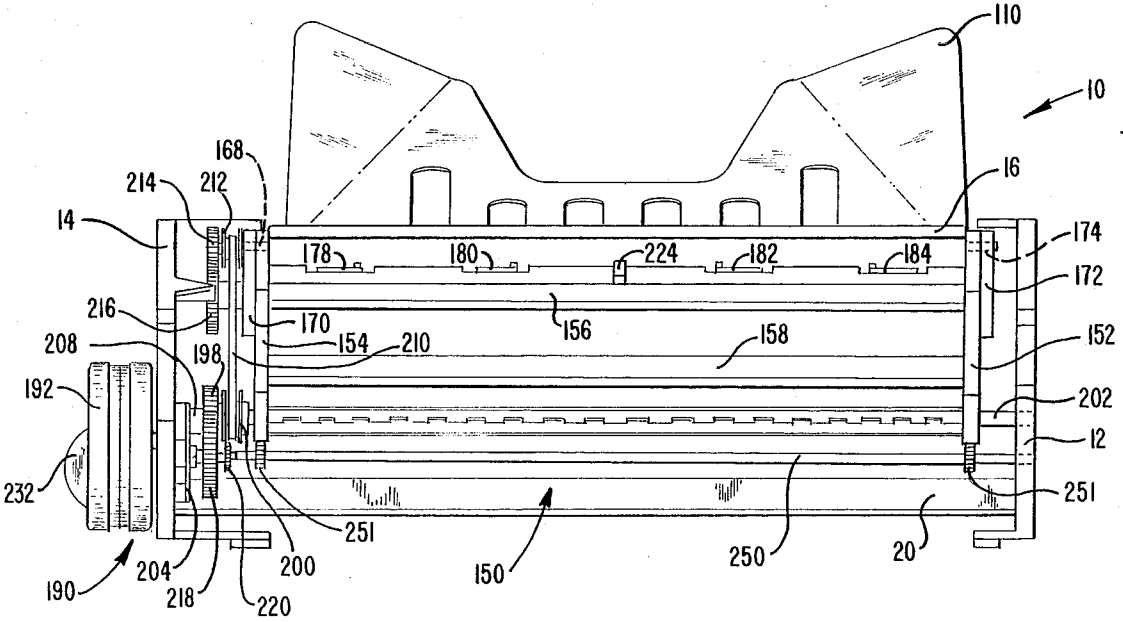
FIG. 4 is a front elevation view of the sorter.
Figure 5:
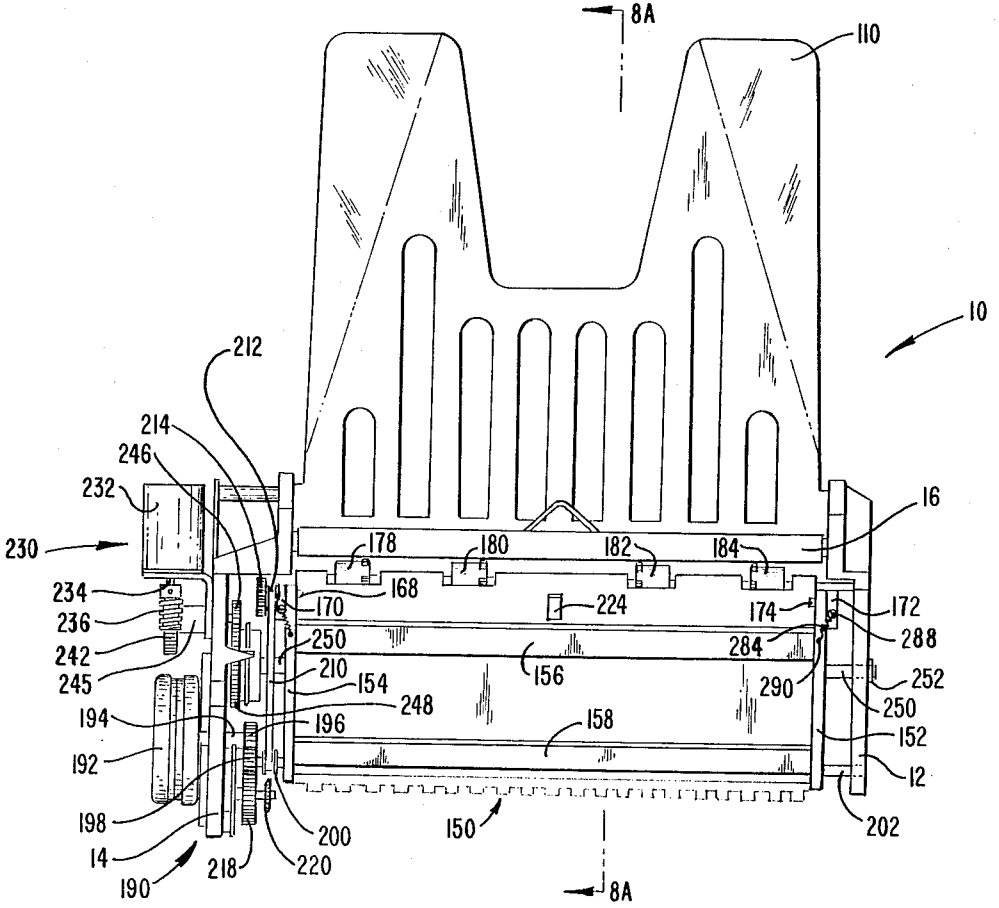
FIG. 5 is a top plan view of the sorter.
Figure 6:
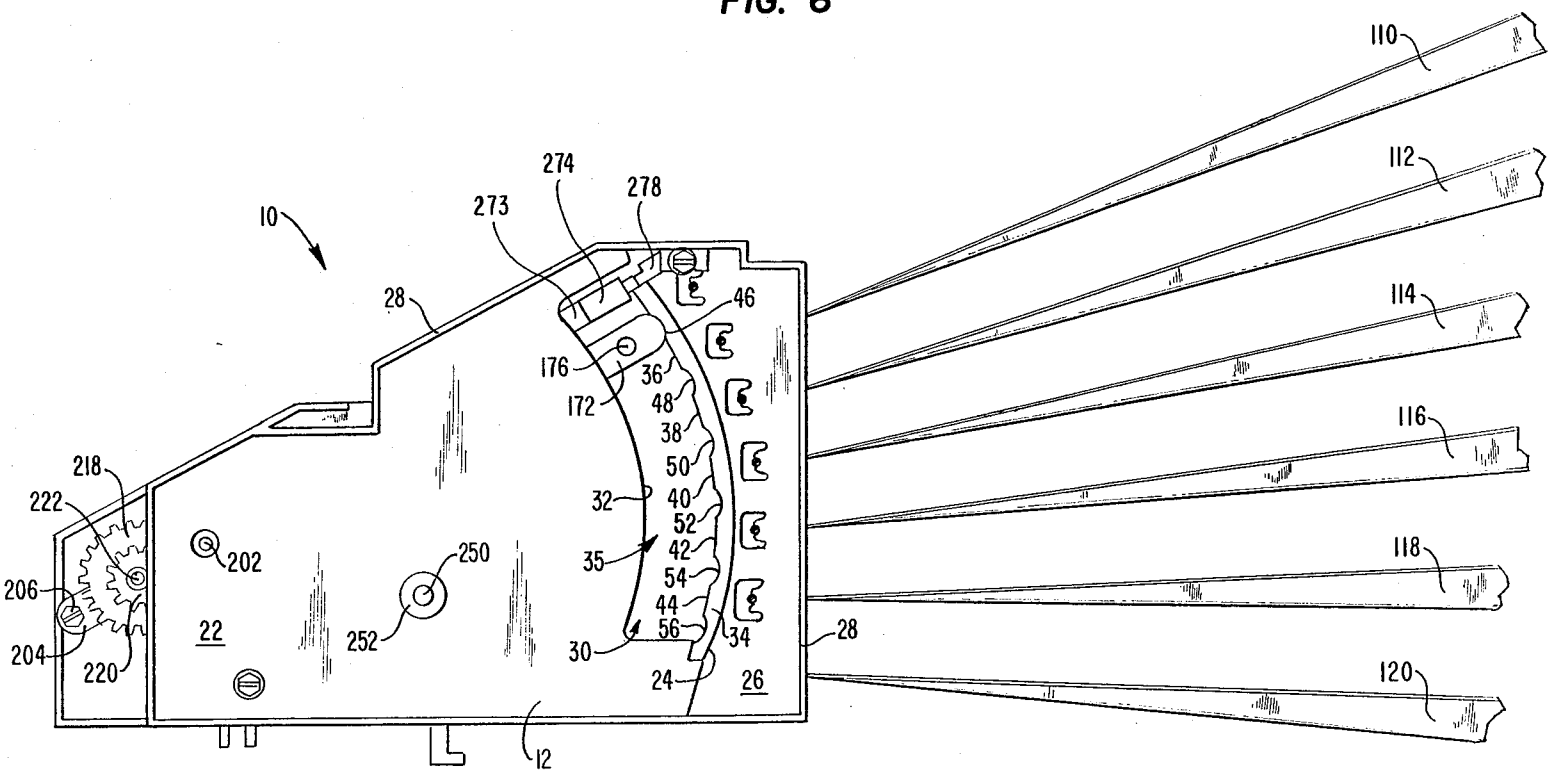
FIG. 6 is a side elevation view of the sorter, with parts removed for clarity, looking at the sorter from the left side thereof.

As shown most clearly in FIGS. 1, 3 and 6, the left side frame member 12 includes a forward wall section 22, an offset wall section 24, a rear wall section 26 and a rim flange 28 which is positioned about the periphery of the various wall sections of frame member 12 to strengthen and rigidify the member.

The left side frame member 12 further includes an arcuate, elongate cut-out portion or aperture therein, shown generally at 30, which encompasses a rear portion of forward wall section 22, and an outer portion of the offset wall section 24. Thus, the rear portion of forward wall section 22 terminates at an edge 32 and the outer portion of offset wall section 24 terminates at an edge 34.

As best shown in FIGS. 3 and 6, the arcuate, forwardly facing surface of offset wall section 24 is provided adjacent the aperture 30 with a series of projections or camming surfaces 36, 38, 40, 42 and 44, and a series of arcuate depressions 46, 48, 50, 52, 54 and 56. The projections 36–44 alternate with the depressions 46–56 on the inner surface of offset wall 24 and serve as a camming means, indicated generally at 35, for purposes and in a manner which will be described in greater detail hereinafter.

Figure 2:
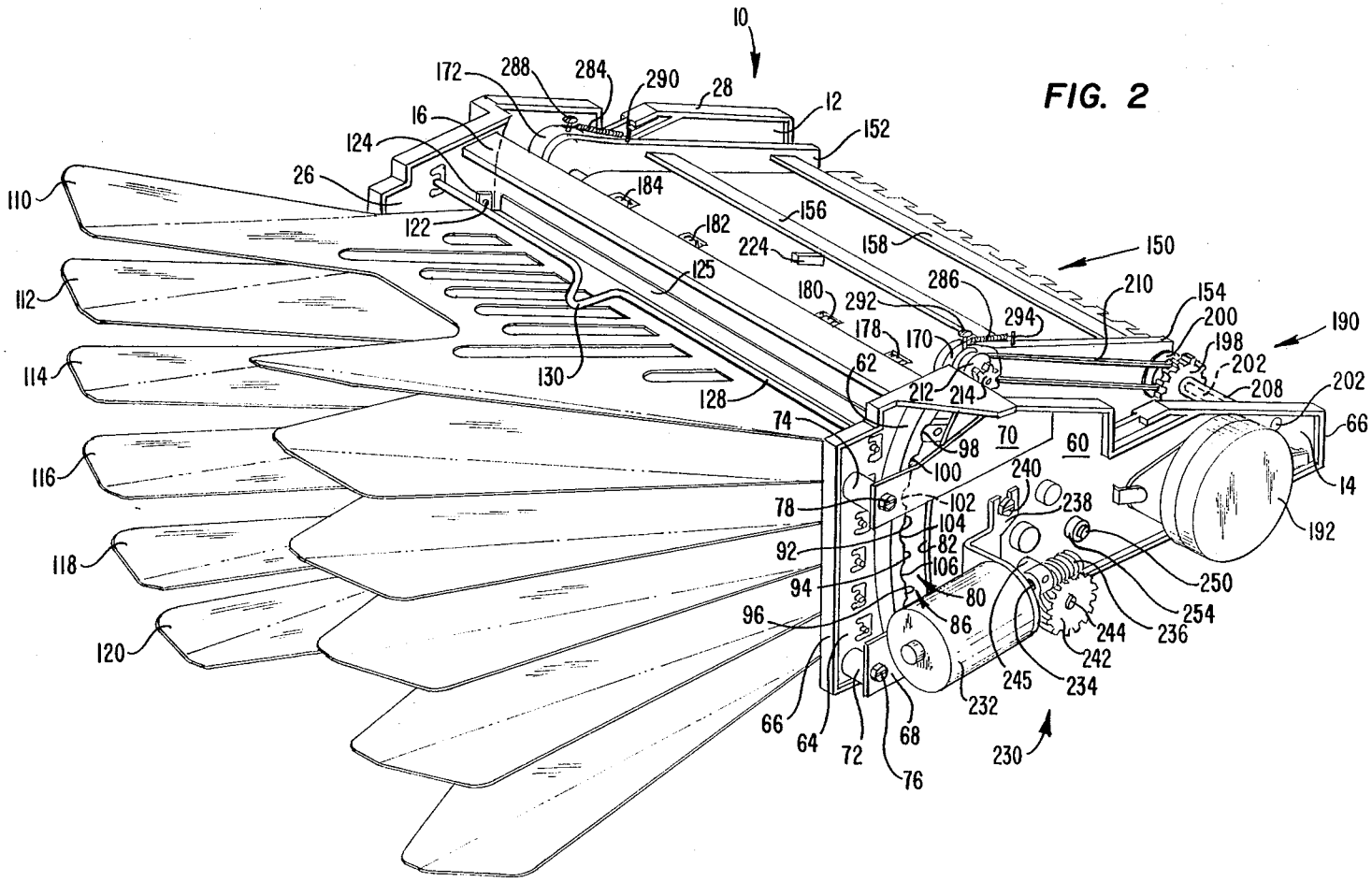
FIG. 2 is a perspective view of the sorter as seen from a point to the rear and to the right thereof.
Figure 7:
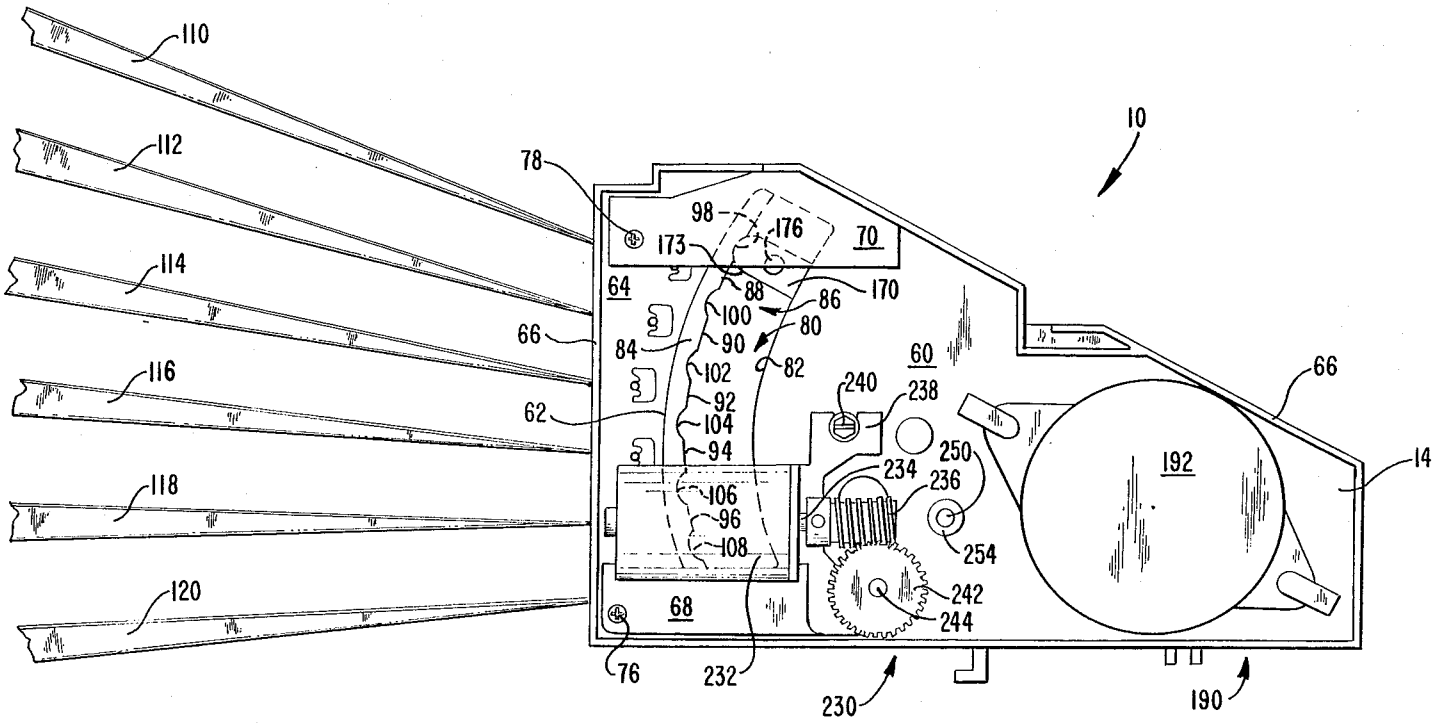
FIG. 7 is a side elevation view of the sorter, looking at the sorter from the right side thereof.

Turning now to FIGS. 2 and 7, the right side frame member 14 of sorter 10 will now be considered in greater detail. Frame member 14 includes a forward wall section 60, an offset wall section 62, a rear wall section 64 and a rim flange 66 which is positioned about the periphery of the various wall sections of frame member 14 to strengthen and rigidify the member. In addition, vertically spaced brackets 68, 70, which are each bonded at one of their ends to the forward walls section 60, are provided to support the rear wall section 64. Brackets 68, 70 are fastened to rear wall section 64 by means of respective stand-offs 72, 74 and bolts 76, 78.

A in the case of left side frame member 12, right side frame member 14 is provided with an arcuate, elongate cut-out portion or aperture therein, shown generally at 80, which forms an edge 82 on the rear portion of forward wall section 60, and an edge 84 on the side portion of offset wall section 62. Also, referring more particularly to FIG. 7, a camming means, shown generally at 86 and including a plurality of projections 88, 90, 92, 94 and 96, is provided on the inner arcuate surface of offset wall portion 62. Arcuate depressions 98, 100, 102, 104, 106 and 108 alternate with the projections 88 through 96. The purposes for and manner of operation of the camming means 86 will be described in greater detail hereinafter.

Figure 8A:
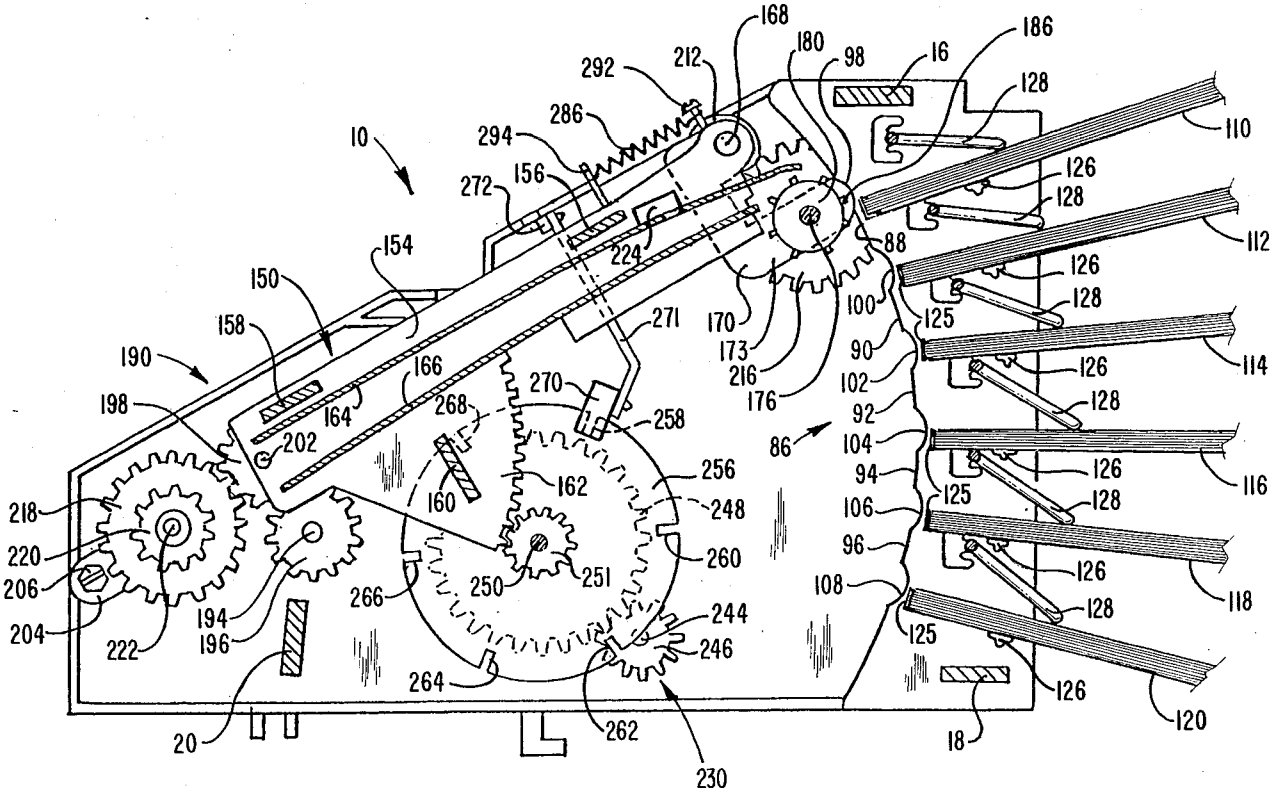
FIG. 8A is a sectional elevational view of the sorter, taken along the line 8A—8A of FIG. 5, with parts removed for clarity, and showing the paper transporting and guiding device indexed to a position in which its downstream end is aligned with the top paper receiving tray of the sorter.
Figure 8B:
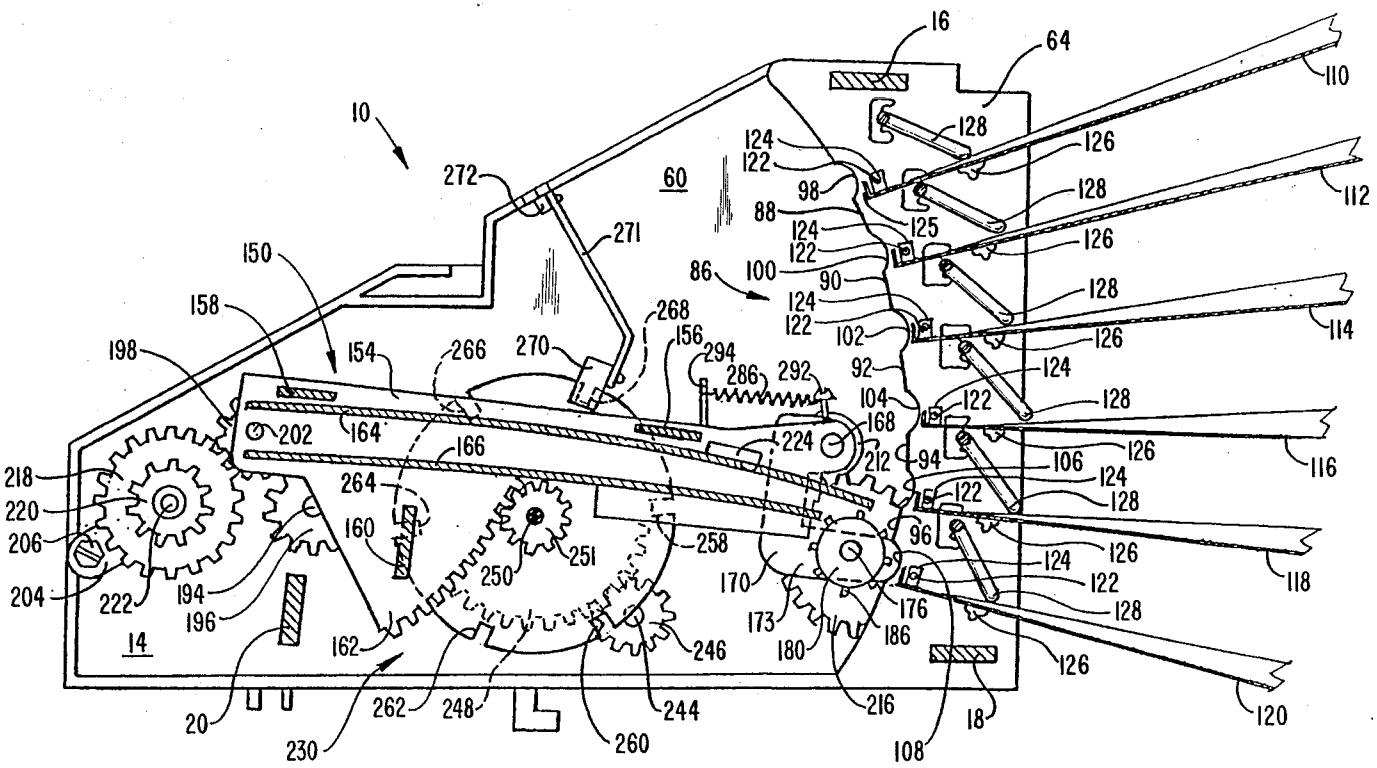
FIG. 8B is a view similar to FIG. 8A but showing the paper transporting and guiding device with its downstream end indexed to a position in alignment with the bottom paper receiving tray of the sorter.

Referring now to FIGS. 2 and 8B, the sorter 10 is provided with a plurality of pivotally supported paper-receiving trays 110, 112, 114, 116, 118 and 120. The input portions of trays 110–120 are pivotally connected to the inboard surfaces of the rear wall sections 26 and 64 of the respective left and right side frame members 12 and 14 by means of pins 122. The pins 122 pass through brackets 124, which are integrally formed on each of the trays, and are integral with the rear wall sections of the frame members. In addition, the upstream ends of trays 110–120 are each provided with a lip 125 which serves to prevent paper sheets that are received in the trays from sliding back into the upstream portion of the sorter after they have been delivered to the trays. Shoulders or support means 126 carried by the rear wall sections 26 and 64 aid in supporting the various trays 110–120 from the side frame members 12 and 14. The various trays 110–120 are aligned respectively with the arcuate depressions 46–56 formed on the inner surface of the offset wall section 12 (FIG. 6), and with the arcuate depressions 98–108 formed on the inner surface of the offset wall sections 62 (FIG. 7).

Referring to FIGS. 2, 3, 9A, 9B and 9C, each of the paper-receiving trays 110–120 is provided with a paper hold-down bar or bail 128 having a bent portion 130 centrally located therein. A shown in FIGS. 9A and 9B, the left ends 129 of the bails 128 are each provided with an arm or flag member, three of which are shown at 132, 134 and 136. The paper hold-down bars 128 of trays 110–120 are pivotally supported in the rear wall sections 26 and 64 of the side frame members 12 and 14. The paper hold-down bars 128 are circular in cross-section where they pass through the rear wall sections and are pivotally supported in the rear wall sections by means of arms 138 and 140 (FIG. 9C) which project into apertures 142 formed in rear wall sections 26, 64. The arms 138 and 140 form a circular recess 144 between them that the bail 128 snaps into. The tips of arms 138, 140 are spaced apart less than the diameter of bails 128 to prevent them from popping out of recess 144. Also, enlargement (not shown) are provided on the bail 128 at both sides of wall section 64 to prevent axial movement of the bails relative to wall sections 26, 64.

Figures 9A, 9B, 9C:
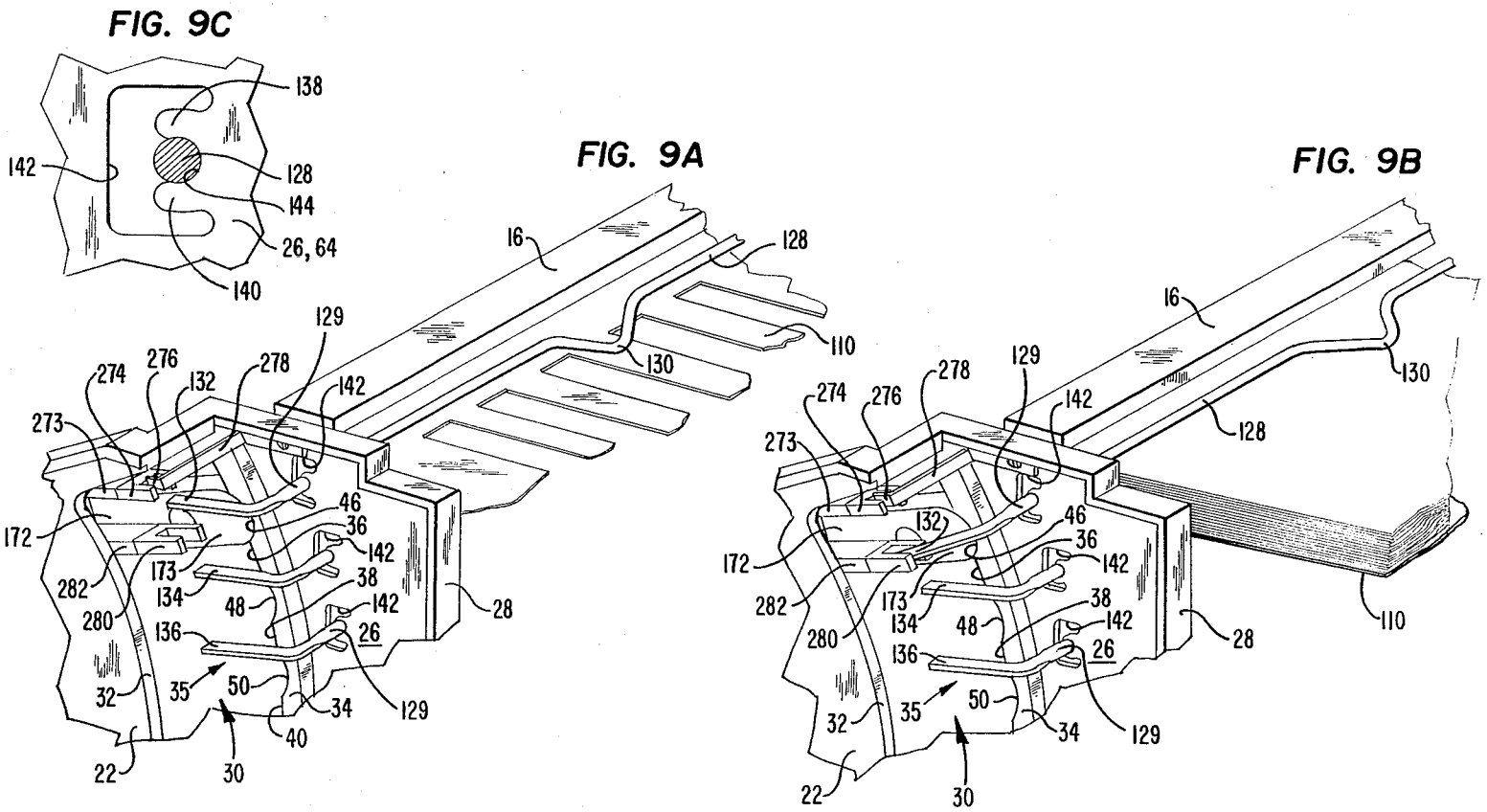
FIGS. 9A, 9B and 9C are enlarged partial perspective views of a sensing mechanism employed in the sorter to signal the sorter when one or more of the paper receiving trays are filled to capacity with sheets of paper.

The bent portions 130 of paper hold-down bails 128 slightly counterbalance the weight of the flag members 132, 134 and 136 so that the various bails 128 tend to assume a position in which the apexes of the bent portions 130 tend to rest on the trays 110–120 or on any paper sheets that are carried on the trays. Thus, as seen in FIG. 9A, when the paper tray 110 is empty, the apex of bent portion 130 rests on the surface o the tray 110 and flag member 132 carried by bar 128 assumes a position which signifies that the paper tray is empty. Conversely, referring to FIG. 9B, when the paper tray is full of paper sheets, the apex of bent portion 130 is elevated by the paper sheets and the flag member 132 is provited to a depressed position, signifying that the paper tray is full. The manner in which the depressed positions of the various flags 132, 134 and 136 are sensed and responded to will be discussed in greater detail hereinafter.

Referring to FIGS. 1–8B, the paper transporting and guiding device, shown generally at 150, will now be described. The paper transporting and guiding device 150 serves as a means for receiving paper sheets from an upstream machine (not shown), with which the sorter 10 cooperates, and delivering the same to the various paper trays 110–120.

The device 150 includes left and right side deflector frames 152 and 154, respectively, which are held in rigid spaced apart relationship by a plurality of crossmembers 156, 158 and 160 (FIG. 8A). The deflector frames 152 and 154 are provided with sector gears, one of which is shown at 162 in FIGS. 8A and 8B, which are integral with an depend from the lower portion of the deflector frames 152 and 154. The deflector frames are preferably molded from a polycarbonate material having carbon fibers (e.g., 8% carbon fibers) therein so that electrostatic charges which might otherwise form on the device 150 may be conducted to ground.

The device 150 is also provided with upper and lower guide plates 164 and 166, respectively, of stainless steel, for example. The guide plates 164 and 166 extend transversely between and are fixed to each of the side deflector frames 152 and 154. In addition, the guide plates 162 and 164 extend longitudinally of the deflector frames 152 and 154 in curved paths that approach each other in the downstream direction, as seen most clearly in FIGS. 8A and 8B. The guide plates 162 and 164 serve to sequentially receive sheets of paper exiting from a machine upstream of the sorter 10 and to guide the sheets of paper in their movement toward the respective ones of paper trays 110–120.

A shaft 168 carried at the downstream end of the right side deflector frame 154 pivotally supports a generally C-shaped depending link 170 (FIG. 8A). A similar C-shaped depending link 172 (FIG. 1) is pivotally supported from the left side deflector frame 152 by means of a corresponding shaft 174. The lower arm portions 173 (FIG. 3) of C-shaped links 170 and 172 rotatably support a shaft 176 that extends therebetween.

The shaft 176 carries a plurality of axially spaced paper transport rollers 178, 180, 182 and 184 thereon, which paper transport rollers are keyed to the shaft 176 and rotate therewith. The paper transport rollers 178–184, which are driven in a manner to be described more fully hereinafter, serve to transport the sheets of paper passing between the guide plates 164, 166 from the paper transporting and guiding device 150 to the selected ones of the paper receiving trays 110–120. To this end the rollers 189–184 are provided with a plurality of driving lugs 186 which project slightly from the rollers at equiangularly spaced locations about a portion of the axial length of the periphery of the rollers. When the end of a sheet of paper passing over the rollers is contacted by one of the driving lugs, the driving lug imparts an extra "kick" to the paper to insure that it is driven home onto the paper tray that it is directed toward.

Referring to FIGS. 1, 2, 4, 5, 7 and 8A, a means for rotating the paper transport rollers 178–184 has been shown generally at 190. Paper transport roller rotating means 190 includes a drive motor 192 carried on the outboard side of right side frame member 14. the motor 192 rotates a shaft 194 which is provided with a drive gear 196 that is keyed thereto. Drive gear 196 engages and drives a driven pinion gear 198 which has fixed thereto, in axial alignment therewith, a timing belt drive pulley 200. The gear 198 and pulley 200 are preferably of polycarbonate material, having 5% PTFE and 10% glass fiber therein. Gear 198 and pulley 200 are rotatably mounted on a stainless steel shaft 202 which is mounted at one of its ends in a bracket 204 carried on the inboard portion of right side frame member 14. the other end of shaft 202 is mounted in the left side frame member 12. Shaft 202 passes through the upstream ends of the left and right side deflector frames 152 and 154, respectively, of the paper transporting and guiding device 150 and, thus, serves as a hinge or pivot on which the upstream end of device 150 is pivotally supported. The bracket 204 is bolted to the inside portion of frame member 14 by means of bolts 206. A sleeve 208 positioned about shaft 202, between the pinion gear 198 and the bracket 204, serves to keep the gear 198 and pulley 200 in their proper axial position on shaft 202.

Pulley 200 is an engagement with and drives a toothed timing belt 210. The timing belt 210, in turn, drives a driving belt pulley 212 that has a gear 214 fixed thereto. The pulley 212 and gear 214 are rotatably supported on the shaft 168 which is affixed to the downstream end of deflector frame 154. The gear 214, in turn, is an engagement with and drives a gear 216 that is keyed to and rotates the shaft 176 on which the paper transport rollers 178–184 are carried. Accordingly, it may be seen that the drive motor 192 of rotating means 190 rotates the paper transport rollers 178-184 via the intermediate power train comprising shaft 194, gear 196, gear 198, pulley 200, belt 210, pulley 212, gear 214, gear 216 and the shaft 176. Drive motor 192 of rotating means 190 is controlled by a photocell sensor 224 carried by upper guide plate 164. The sensor 224 senses the reflection of light directed downwardly toward lower guide plate 166, which is provided with a blackened, non-reflecting surface in the area below photocell sensor 224 so that, in the absence of a sheet of paper on guide plate 166, the sensor remains de-activated. When a sheet of paper arrives between plates 164 and 166, the sensor becomes activated and causes drive motor 192 to rotate rollers 178–184 to transfer the sheet of paper to one of the trays 110–120.

The pulley 212 and gear 214 are preferably made of a polycarbonate material having 5% PTFE and 10% glass fiber therein so that they can rotate freely on shaft 168, which is preferably of stainless steel. A shown most clearly in FIG. 1 and 8A, the drive motor 192 also drives a pair of power take-off gears 218 and 220 which are carried on a shaft 222 that is supported by bracket 204. The gears 218 and 220 are driven from motor 192 via a power train that includes shaft 194, gear 196 and gear 198. The power take-off gears 218 and 220 may be used to drive auxiliary equipment (not shown), for example a paper feed mechanism, that may be employed with the machine which is outputting paper sheets to the sorter 10. Suitable override controls may be provided to allow motor 192 to rotate gears 218 and 220 when sensor 224 does not call for rotation of motor 192.

Referring to FIGS. 1, 2, 5, 7, 8A, 8B, 9A and 9B an indexing means, shown generally at 230, for indexing the paper transporting and guiding device 150 to selected ones of the paper trays 110–120, has there been illustrated. The indexing means 230 includes a DC drive motor 232 having an output shaft 234 which carries a worm gear 236 thereon. DC motor 232 is supported from the forward wall section 60 of right side frame member 14 by a bracket 238 and bolts 240.

The worm gar 236 of DC motor 232 engages with and drives a gear 242 that is keyed to a shaft 244 which rotates in unison with the gear 242. Shaft 244 is rotatably supported in the forward wall section 60 by means of a boss 245 that is integral with the wall section. The boss 245 also serves to axially position gear 242 so as to maintain it in engagement with worm gear 246. The opposite end of shaft 244 has a gear 246 keyed thereto, which gear is located inboard of the wall section 60. Gear 246 is in mesh with and rotates a gear 248 that is carried by and keyed to a shaft 250 that extends transversely of the entire sorter 10 and has its ends supported in a boss 252 (FIG. 1) on left side frame member 12 and in a boss 254 (FIG. 2) in right side wall member 14. Shaft 250 has a pair of spaced gears 251 keyed to it, which gears are in engagement with the sector gears 162 on deflector frames 152 and 154 to arcuately move the downstream end of paper transporting and guiding device 150 when shaft 250 is rotated. Shaft 250 also supports a disk 256 (FIG. 8A) having a plurality of radially oriented slots 258, 260, 262, 264 and 268 cut into the periphery of the disk 256 at positions angularly spaced apart 60° from one another. The positions of slots 258–268 correspond to the respective arcuate depressions 46–56 (FIG. 3) and 980108 (FIGS. 7 and 8A) which, in turn, correspond to paper receiving trays 110–120, respectively.

Thus, referring to FIGS. 3 and 8A, when the lower, rearwardly projecting, portions 173 of C-shaped links 170 and 172 are engaged with arcuate depressions 98 and 46, respectively, and the rollers 178–184 are positioned to transport paper sheets into paper receiving tray 110. The radial slot 258 of disk 256 is at this time in alignment with a photocell sensor 270 to signal the control circuits (not shown) of the sorter 10 that the paper transporting and guiding device 150 is aligned with paper receiving tray 110. The photocell sensor 270 is supported by a bracket 271 that is fastened to a flange 272 integral with the forward wall section 60 of sorter 10.

Referring to FIG. 8B it will be seen that when the paper transporting and guiding device 150 is an alignment with paper-receiving tray 120, at which time the lower downstream projecting arm 173 of link 170 is in engagement with the arcuate depression 108, slot 268 of disk 256 is in alignment with photo cell sensor 270 to signal the control circuits of sorter 10 that the output of paper transporting and guiding device 150 is in alignment with paper-receiving tray 120.

Referring to FIGS. 1, 3, 9A and 9B, the left deflector frame 152 of paper transporting and guiding device 150 fixedly carries a bracket 273 thereon which supports another photocell sensor 274. Sensor 274 cooperates with an arm 276 fixedly carried by a bracket 278 fastened to the rear wall section 26 of the sorter. When the paper transporting and guiding device 150 is in the position shown in FIGS. 3 and 9A, the photocell sensor 274 (FIG. 3) is in alignment with arm 276, providing a signal to the sorter control circuits that the device 150 is in its uppermost position. An alternative embodiment of the sorter employs a pair of striker plates (not shown), carried by the side frame members 12 and 14, in place of the photocell sensor 274, arm 276 and bracket 278, and when the device 150 reaches its uppermost position, the deflector frames 152 and 154 abut against the striker plates, providing a "stall" signal to the sorter control circuits, signifying the arrival of the device 150 at its uppermost position.

As may be seen by inspection of FIGS. 9A and 9B, the sorter is adapted to provide a signal to the sorter control circuits when the paper trays are full. A shown in FIGS. 9A and 9B, yet another photocell sensor 280, which is carried by an arm 282 that is fastened to the left side deflector frame 152 (FIG. 1) by means of a bracket (not shown), is employed to cooperate with the various flag members 132–136 that are fastened to the left ends of the bails or bars 128. When the paper transporting and guiding device 150 is in its top position, adjacent to tray 110 and the paper tray is not full (FIG. 9A), the flag member 132 is out of alignment with the photocell sensing device 280 so that no "tray full" signal is transmitted to the sorter control circuits. On the other hand, when paper tray 110 is full, as shown in FIG. 9B, the bent portion 130 of bail 128 is elevated, causing flag 132 to be lowered into a position which interrupts the light beam that triggers the photosensitive element of photocell sensor 280, thereby providing a "tray full" interrupt signal to the sorter control circuits. Similar actions occur with respect to paper trays 112–120 and their respective flags corresponding to flags 132–136.

Referring to FIGS. 1–3 and 8A, the manner in which the depending C-shaped links 170 and 172 are biased into their respective camming means 86 and 35 will now be considered. As indicated earlier, the camming means 86 (FIG. 8A) includes a plurality of alternating arcuate depressions 98–108 and projections, or camming surfaces, 88–96. Similarly, the camming means 35 (FIG. 3) comprises a plurality of alternating arcuate depressions 46–56 and projections, or camming surfaces, 36–44. The links 170 and 172, which are pivotally supported from respective shaft 168 and 174, are pivoted about their respective support shafts as the indexing means 230 moves the paper transporting and guiding device 150 between the various trays. The projecting arms 173 of links 172 and 170 are biased into engagement with the camming means 35 and 86 by respective springs 284 and 286 (FIG. 2). Spring 284 has one of its ends fastened to a screw 288 that is fixed to the top arm of C-shaped link 172. The other end of spring 284 is fastened to a post 290 that is fixed to the left side deflector frame 152. Similarly, spring 286 has one of its ends fixed to a screw 292 that is fastened to the top of C-shaped link 170, and the other of its ends is fixed to a pin 294 that is carried by the right side deflector frame 154. Accordingly, the springs 284 and 286 bias the lower portions 173 of the deflecting links 170 and 172 into engagement with their respective camming means 86 and 35, and the links 170 and 172 move the paper transport rollers 178–184 on shaft 176 into and out of positions adjacent the various paper trays 110–120 as the indexing means 230 indexes the paper transporting and guiding device 150 between the various paper trays 110–120. The springs and camming arrangements thus allow the rollers 178–184 to clear the input ends of the trays 110–120 and stacked paper during their movement from tray to tray.

Figure 10:
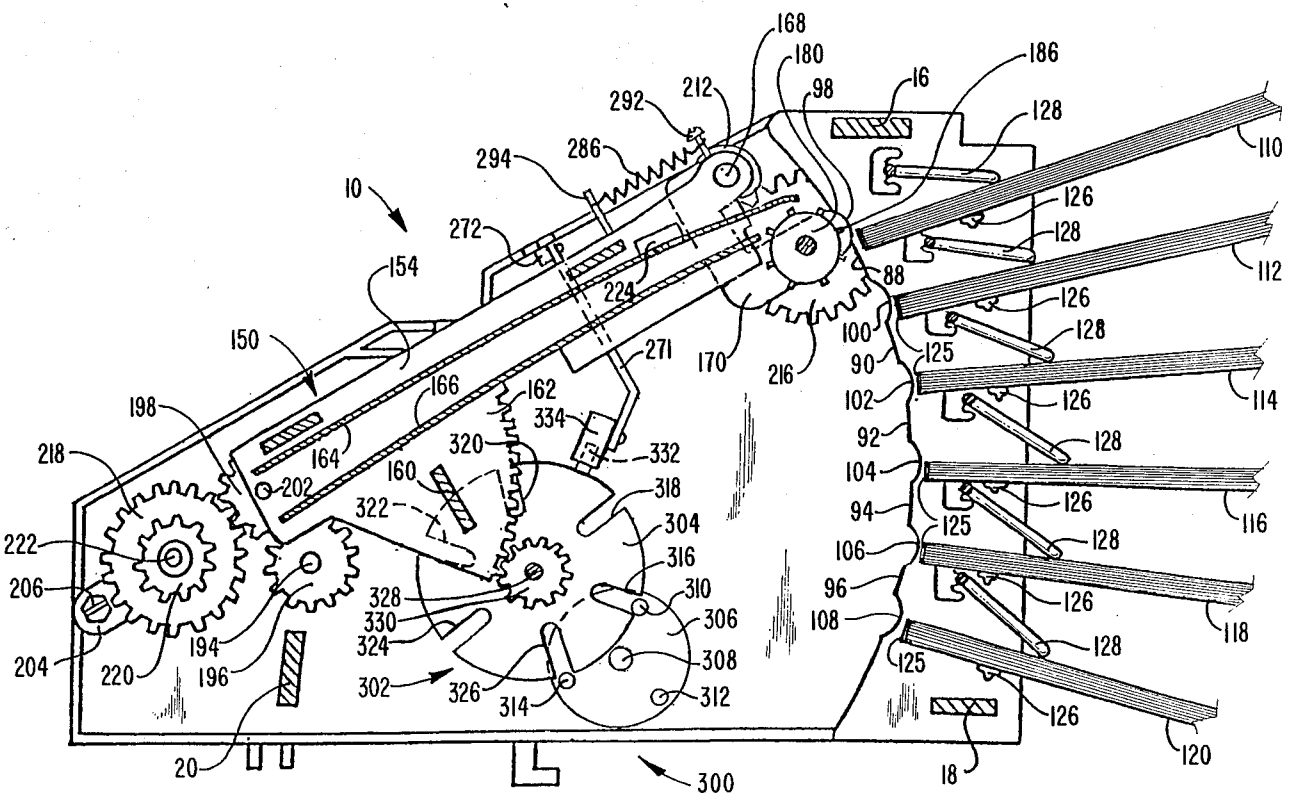
FIG. 10 is a view similar to FIG. 8A but illustrating an alternate embodiment of the sorter in which the indexing means for indexing the downstream end of the paper transporting and guiding device is different from that shown in FIG. 8A.

Referring now to FIG. 10, an alternate embodiment of the indexing means for indexing the paper transporting and guiding device 150 to selected ones of the paper trays 110–120 has been illustrated generally at 300. The indexing means 300 employs a Geneva Drive mechanism, shown generally at 302, which includes a star gear wheel 304 and a pin wheel 306. The pin wheel 306 is driven by a stepper drive motor (not shown) via a power train including an output shaft 308 on which pin wheel 306 is mounted and to which it is keyed. The pin wheel 306 is provided with three axially-extending pins 310, 312 and 314, which are positioned adjacent the periphery of the pin wheel at locations that are angularly spaced from one another by 120°. The output shaft 308 of the stepper motor is arranged to step in 120° angular increments when the motor is actuated. The pins 310–314 are adapted to engage corresponding slots 316, 318, 320, 322, 324 and 326 which are formed in star gear wheel 304 and extend radially inwardly from the periphery thereof at 60° angularly spaced locations about the periphery of the star gear wheel.

Star gear wheel 304 is carried on and keyed to a shaft 328 which extends transversely of the sorter 10 and is mounted at its ends in the left and right side wall frame members of the sorter. The shaft 328 also carries a pair of gears, one of which is shown at 330, which are keyed thereto and engage the sector gears 162 on the left and right side deflector frames 152 and 154. Accordingly, when the pin wheel 306 is rotated clockwise by an angular movement of 120° from the position shown in FIG. 10, pin 314 moves from its position shown in FIG. 10 to the position shown occupied by pin 310 of that figure. This movement of the pin wheel 306 causes pin 314 to enter into slot 326 and move slot 326 counterclockwise from the position it is shown as occupying in FIG. 10 to the position shown occupied by slot 316 in FIG. 10. Accordingly, gear 330 rotates 60°, causing the sector gear 162 to move downwardly and reposition the paper transporting and guiding device 150 so that its downstream end is in alignment with paper tray 112.

Additional 120° angular rotations of the pin wheel 306 caused additional 60° angular rotations of the star gear wheel 304, resulting in indexing of the downstream end of the device 150 to other ones of the trays 110–120. The star gear wheel 304 is provided with a flag member 332 on its outer periphery which cooperates with a photocell sensor 334 to provide s signal to the control circuits of sorter 10 that the paper transporting and guiding device 150 is in its uppermost position adjacent to paper receiving tray 110.

The various functions of the sorter are controlled by circuitry incorporating conventional microprocessor logic elements. Although a microprocessor may be incorporated in the sorter itself, it is generally preferred to employ existing microprocessor capacity in the upstream machine. Where the upstream machine is a typical laser printer incorporating an internal processor, each of the sensors and motors in the sorter is connected to the internal processor of the upstream machine through an interfacing cable and plug.

The logic circuit, whether internal or external, typically performs a "power-on" sequence when the sorter is first actuated. In the power-on sequence, the logic circuit brings the paper transporting and guiding device 150 to the home or upper most position. With the DC-motor driven unit of FIGS. 1–8B, the logic circuit tests the output from sensor 274 (FIG. 3). A signal from sensor 274 indicating that the sensor is not blocked by arm 276 indicates that the paper transporting and guiding device 150 is out of its home or uppermost position. The logic circuit then actuates DC motor 232 swing device 150 upwardly, until it reaches the home position as indicated by a signal from sensor 274. With the embodiment of FIG. 10, the home position is found by the same sequence of operations at power-on. However, the signal indicating that the paper transporting and guiding device 150 is in its home position comes from sensor 334.

After the power-on sequence, the logic circuit responds to externally supplied sorter control commands to bring the paper transporting and guiding device to the appropriate tray indicated by the command. Where the sorter is associated with a printer, the sorter control commands may be embedded in the data stream sent to the printer. Thus, the internal logic of the printer is arranged to recognize preselected code sequences as denoting sorter commands rather than characters to be printed or printer control commands. The predetermined code sequences denoting sorter control commands may be so-called "escape sequences", i.e., sequences incorporating the ASCII escape code with one or more additional codes. The sorter control command will include a number designating the tray for a particular document and hence indicating the desired position of the paper transporting and guiding device.

The logic circuit associated with the sorter maintains a count in a register indicating the current position of the paper transporting and guiding device 150, increments or decrements the count as the guiding device moves during operation and actuates the drive system until the position as indicated by the count matches the desired position indicated by the sorter control command. During the power-on sequence, the current position count is set ot a predetermined initial value of 1, indicating that the device 150 is in the first or home position. In the DC motor drive embodiment of FIGS. 1–8B, the logic circuit increments or decrements the position register each time a signal is received from sensor 270 (FIG. 8A). Whether the register is incremented or decremented will depend upon the direction of motion, i.e., on the particular direction command issued by the control logic. For example, if the first document sent to the sorter after a power-on sequence is accompanied by a sorter control command indicating that the document is to go into the fourth tray 116, the control logic will compare this command with the current position count in the register and will determine that the tray number indicated by the command is higher than the current position count. Accordingly, the control logic will command the drive motor to swing the paper transporting and guiding device 150 downwardly, towards the higher-numbered positions. Having commanded the motor to drive the device 150 in this direction, the logic circuit will be set to increment the position register each time a signal is received from sensor 270. This will continue until the count in the position register reaches 4 and coincides with the position number indicated in the command, whereupon the logic circuit will stop the drive motor.

If the next command indicates a lower tray position number, for example, where the next sheet is to be deposited in the second tray 112, the logic circuit will determine that the current position count is higher than the position number indicated by the command and hence will actuate the drive motor to swing device 150 in the lower number or upward direction. During this motion, the logic circuit will decrement the current position count in the register on each signal from sensor 270, again terminating the process when the current position count matches the position number indicated in the command.

Substantially the same logic is employed with the stepper motor driven embodiment of FIG. 10. Here again, the logic circuit maintains a current position count in a register. However, the count is incremented or decremented each time the stepper motor performs a predetermined number of steps in a given direction. For example, where N steps of the motor correspond to 120° rotation of pin wheel 306, and hence correspond to one position movement of paper transporting and guiding device 150, the logic circuit will increment or decrement the count upon issuing N step commands to the stepper motor. Again, whether the current position count is incremented or decremented will depend upon the direction of movement and hence upon the direction of the steps as commanded by the logic circuit. The logic circuit will select the direction of motion and hence the direction of the steps to be commanded by comparing the position indicated in a sorter control command with the current position indicated by the count.

As mentioned above, drive motor 192 and hence paper drive rollers 178–184 are controlled by sensor 224. When the sensor first detects a sheet of paper passing downstream in device 150, as when the leading edge of the sheet reaches the sensor, the sensor sends a signal to the logic circuit, which in turn actuates drive motor 192. When the trailing edge of the sheet passes the sensor, the sensor sends a further, opposite signal to the logic circuit. The logic circuit times out a predetermined delay and, after that delay, stops the drive motor. The delay is selected based upon the speed of the drive rollers and the dimensions of the unit so that during the delay period the rollers will necessarily bring the trailing edge all the way through the guiding device 150 and into the tray. The logic circuit may also time the period starting with passage of the leading edge and issue an alarm signal if the trailing edge passage signal is not received within a predetermined time thereafter. Also, the logic circuit associated with the sorter may respond to signals from the full-tray sensor 280 (FIGS. 9A and 9B). A signal from sensor 280 indicating that it has been obscured by one of the flag members 132–136 indicates that one of the trays is full. The position count mentioned above can be used to identify the particular tray. Thus, if the position count is 4, the paper transporting and guiding device 150, and hence sensor 280, are aligned with tray number 4, and a signal from sensor 280 therefore will mean that tray number 4 is full. This information may be used to trigger an appropriate indication or alarm.

From the foregoing description, it can be seen that the present invention provides an improved high speed sorter in which the various paper trays are stationarily arranged and may be randomly accessed by a pivotable deflecting device which directs the sheets of paper to selected ones of the trays. The resulting sorter is flexible, economical, sturdy in construction and reliable in operation.

While there have been shown and described what are presently considered to be the preferred embodiments of this invention, it will be obvious to those skilled in the art that various changes and modifications may be made without departing from the broader aspects of this invention. It is, therefore, aimed in the appended claims to cover all such changes and modifications that fall within the true spirit and scope of this invention.

What is claimed is:

1. A sorter for use with an upstream machine that sequentially delivers individual sheets of paper to said sorter, comprising:

A. a frame having an upstream paper-input portion and a downstream paper-output portion;

B. a plurality of support means carried by said frame for supporting paper-receiving trays having input portions thereon with their input portions arcuately positioned about the paper-output portion of said frame;

C. a paper transporting and guiding device having upstream and downstream portions thereon, said device having its upstream portion pivotally supported on the upstream portion of said frame and its downstream portion arcuately movable into and out of alignment with the various input portions of said paper-receiving trays, said device including transport roller means for transporting from said device to said trays sheets of paper delivered to said sorter by said machine, said transport roller means being pivotally supported on said downstream portion of said paper transporting and guiding device so as to be movable between a first position adjacent the input portion of a paper-receiving tray and a second position spaced upstream from said input portion of said paper-receiving ray, and said device further including biasing means for biasing said transport roller means toward said first position; and D. indexing means carried by said frame and coupled to said paper transporting and guiding device for moving said downstream portion of said device into alignment with the input portions of selected ones of said trays.

2. A sorter according to claim 1, further including camming means cooperable with said transport roller means for moving said transport roller means to its second position when said paper transporting and guiding device is indexing between the input portion of one paper-receiving tray and the input portion of another paper-receiving tray.

3. A sorter according to claim 2, wherein said indexing means includes a sector gear carried by said paper transporting and guiding device, a pinion gear rotatably carried by said frame and in engagement with said sector gear, and a DC drive motor carried by said frame and drivingly coupled to said pinion gear for rotating said pinion gear and said sector gear to thereby pivot said transporting and guiding device from its alignment with one paper-receiving tray into alignment with another paper-receiving tray.

4. A sorter according to claim 3, further including sensing means cooperating with said indexing means for providing a signed in said sorter that said paper transporting and guiding device is in one or another of its positions in alignment with the input portions of each of the paper-receiving trays.

5. A sorter according to claim 2, wherein said indexing means includes sector gear carried by said paper transporting and guiding device, a pinion gear rotatably carried by said frame and in engagement with said sector gear, a stepper drive motor carried by said frame, a Geneva Drive mechanism, including a star gear wheel and a pin wheel coupled between said pinion gear and said stepper drive motor, for pivoting said transporting and guiding device from its alignment with one paper-receiving tray into alignment with another paper-receiving tray.

6. A sorter according to claim 5, further including sensing means cooperating with said Geneva Drive mechanism for providing a signal in said sorter signifying that said paper transporting and guiding device is in alignment with a predetermined one of said input positions of said paper-receiving trays.

7. A sorter according to any of claims 1, 2, 6 further including roller drive means coupled to said transport roller means for rotating said transport roller means, and sensing means carried by said paper transporting and guiding device for sensing the presence of a sheet of paper in said device, said sensing means activating said roller drive means upon sensing the present of a sheet of paper in said device to rotate said transport roller means, whereby said sheet of paper is transferred from said device to said paper-receiving tray, said sensing means deactivating said roller drive means when said sheet of paper has been transferred from said device to said tray.

8. A sorter according to claim 7, further including a flag member carried by said frame adjacent the input portion of a selected one of said paper-receiving trays, and second sensing means carried by said paper transporting and guiding device and cooperable with said flag member for sensing when said device is in alignment with said tray and providing a signal in said sorter representative of such alignment.

9. A sorter according to claim 8, further including a plurality of bail members, each of which is pivotally carried by said frame and is cooperative with a corresponding one of said paper-receiving trays, for holding the paper sheets received by said trays against said trays, a flag member carried by each of said bail members at one end thereof, and third sensing means carried by said paper transporting and guiding device and cooperative with said flag members for providing signals in said sorter indicating that one or more of said trays is full of paper.

10. A sorter for use with an upstream machine that sequentially delivers individual sheets of paper to said sorter, comprising:

A. a frame having an upstream paper-input portion and a downstream paper-output portion;

B. a plurality of paper-receiving trays carried by said frame, said trays having corresponding input portions thereon arcuately positioned about the paper-output portion of said frame;

C. a paper transporting and guiding device having upstream and downstream portions thereon, said device having its upstream portion pivotally supported on the upstream portion of said frame and its downstream portion arcuately movable amongst the various input portions of said paper-receiving trays, said device including transport roller means for transporting from said device to said trays sheets of paper delivered to said sorter by said machine, said transport roller means being pivotally suspended from said downstream portion of said device and being movable between a downstream position adjacent the input portion of said trays and an upstream position spaced from said tray input portions, and said device further including biasing means for biasing said transport roller means toward its downstream position;

D. indexing means carried by said frame and coupled to said paper transporting and guiding device for moving said downstream portions of said device into alignment with the input portion so selected ones of said trays; and E. camming means formed on said frame and cooperable with said transport roller means during indexing movement of said paper transporting and guiding device for camming said roller means to said upstream position during said indexing movement.

11. A sorter according to claim 10, wherein said paper transporting and guiding device includes first and second transversely spaced-apart deflector frame members, first and second transversely spaced-apart C-shaped links pivotally supported at their upper ends from the downstream ends of said deflector frame members, a roller member rotatably supported between the lower ends of said links, and first and second transversely spaced-apart spring members each of which has one of its ends fastened to one of said deflector frame members and the other of its ends fastened to one of said links so as to bias the lower ends of said links in a downstream direction against said camming means.

12. A sorter according to claim 11, wherein said deflector frame members each include a downwardly extending sector gear thereon, and said indexing means includes first and second transversely spaced-apart pinion gears carried by said frame, each of said pinion gears being in engagement with a different one of said sector gears for indexing said paper transporting and guiding device.

13. A sorter according to claim 12, wherein said indexing means further includes a DC drive motor carried by said frame means and drivingly coupled to said pinion gears for rotating said pinion gears and said sector gears.

14. A sorter according to claim 13, further including sensing means cooperating with said indexing means for providing a signal in said sorter signifying that said paper transporting and guiding device is in one or another of its positions in alignment with the input portions of each of the paper-receiving trays.

15. A sorter according to claim 12, wherein said indexing means further includes a stepper drive motor carried by said frame, and a Geneva Drive mechanism, including a star gear wheel and a pin wheel, coupled between said stepper drive motor and said pinion gears.

16. A sorter according to claim 15, further including a flag member carried by one of said wheels, and a sensing means cooperating with said flag member for providing a signal in said sorter signifying that said paper transporting and guiding device is in alignment with a predetermined one of said paper-receiving tray input positions.

17. A sorter for use with an upstream machine that sequentially delivers individual sheets of paper to said sorter, comprising:

A. a frame having an upstream paper-input portion and a downstream paper-output portion;

B. a plurality of support means carried by said frame for supporting paper-receiving trays having input portions thereon with their input portions arcuately positioned about the paper-output portion of said frame;

C. a paper transporting and guiding device having upstream and downstream portions thereon, said device having its upstream portion pivotally supported on the upstream portion of said frame and its downstream portion arcuately movable into and out of alignment with the various input portions of said paper-receiving trays, said device including paper-output transport means for transporting from said device to said trays sheets of paper delivered to said sorter by said machine, said paper-output transport means being carried on said downstream portion of said device and being movable between an extended position and a retracted position, and said device further including means for biasing said paper-output transport means toward said extended position;

D. indexing means carried by said frame and coupled to said paper transporting and guiding device for moving said downstream portion of said device into alignment with the input portions of selected ones of said trays; and E. camming means carried by said frame and in engagement with said paper-output transport means for moving said paper-output transport means toward said retracted position during movement of the downstream portion of said paper transporting and guiding device between the input portions of said selected ones of said trays.

* * * * *

UNITED STATES PATENT AND TRADEMARK OFFICE

CERTIFICATE OF CORRECTION

PATENT NO. : 4,830,358

DATED : May 16, 1989

INVENTOR(S) : Fazio, et al.

It is certified that error appears in the above-identified patent and that said Letters Patent is hereby corrected as shown below:

Column 1, line 7, "rays" should read --trays--;
line 59, "rays" should read --trays--.

Column 4, line 24, delete "provited" and insert therefor --pivoted--.

Column 5, line 10, delete "189-184" and insert therefor --178-184--.

Column 6, line 26, delete "gar" and insert therefor --gear--;
line 32, delete "246" and insert therefor --236--;
line 50, delete "980108" and insert therefor --98-108--.

Column 9, line 17, after "232" insert --to--.

Column 12, line 26, delete "2, 6" and insert therefor --2-6--.
line 32, delete "present" and insert therefor --presence--.

Column 13, line 19, "portion" should read --portions--; delete "so" and insert therefor --of--.

UNITED STATES PATENT AND TRADEMARK OFFICE

CERTIFICATE OF CORRECTION

PATENT NO. : 4,830,358

DATED : May 16, 1989

INVENTOR(S) : Fazio, et al.

It is certified that error appears in the above-identified patent and that said Letters Patent is hereby corrected as shown below:

Column 13, line 19, "portion" should read --portions--; delete "so" and insert therefor --of--.

Signed and Sealed this

Twentieth Day of February, 1990

*Attest:*

JEFFREY M. SAMUELS

*Attesting Officer*

*Acting Commissioner of Patents and Trademarks*